US009421664B1

(12) United States Patent
Yu

(10) Patent No.: US 9,421,664 B1
(45) Date of Patent: Aug. 23, 2016

(54) TABLE TOP ROCK TUMBLER

(71) Applicant: Felix Yu, Kowloon (HK)

(72) Inventor: Felix Yu, Kowloon (HK)

(73) Assignee: Soma International Ltd., Kowloon (HK)

( * ) Notice: Subject to any disclaimer, the term of this patent is extended or adjusted under 35 U.S.C. 154(b) by 29 days.

(21) Appl. No.: 14/666,613

(22) Filed: Mar. 24, 2015

(51) Int. Cl.
*B24B 31/00* (2006.01)
*B24B 31/02* (2006.01)

(52) U.S. Cl.
CPC ..... *B24B 31/02* (2013.01)

(58) Field of Classification Search
CPC ..... B24B 31/02; B24B 31/03; B24B 31/023; B24C 3/26; B08B 7/0092
USPC ..... 451/328
See application file for complete search history.

(56) References Cited

U.S. PATENT DOCUMENTS 1,359,273 A * 11/1920 Purinton ..... C25D 17/20 204/214
2,376,106 A * 5/1945 Witthofft ..... A23N 7/02 366/220
3,167,890 A * 2/1965 Smith ..... B24B 31/023 451/328
3,553,902 A * 1/1971 Christensen ..... B24B 31/02 451/328
3,765,131 A * 10/1973 Christensen ..... B24B 31/02 366/220
3,776,186 A * 12/1973 Coch ..... C23C 24/045 118/418
3,971,167 A * 7/1976 van Moppes ..... B24B 31/02 241/176
4,045,918 A 9/1977 Freedman
4,519,812 A * 5/1985 Brull ..... B24C 3/263 451/326
4,800,605 A * 1/1989 Arneson ..... A47L 21/02 15/210.1
4,848,122 A * 7/1989 Sullivan ..... B24B 31/02 29/90.1
4,987,702 A * 1/1991 Anschutz ..... B24B 31/03 15/3.16
6,254,466 B1 7/2001 Mucciacciaro et al.
6,379,233 B1 * 4/2002 Kobayashi ..... B24B 31/12 451/326

* cited by examiner

*Primary Examiner* — George Nguyen
(74) *Attorney, Agent, or Firm* — Buchanan Ingersoll & Rooney PC

(57) ABSTRACT

An ultra-quiet rock tumbler has a barrel assembly supported on a barrel support having two uprights extending from a base. The barrel assembly has an inner barrel with a removable top, that fits into a middle barrel having a removable top and the middle barrel fits into an outer barrel having a removable top. Energy absorbing material, preferably polyurethane foam, surrounds both the inner barrel and the middle barrel. A motor is provided in the barrel support for rotating the barrel assembly.

20 Claims, 5 Drawing Sheets

TABLE TOP ROCK TUMBLER

FIELD OF INVENTION

The invention relates to rock tumblers that are used to polish stones.

BACKGROUND OF THE INVENTION

A common procedure in the abrading, polishing and finishing of irregularly shaped objects, for example, stones and minerals in lapidary practice, both professional and amateur, is to tumble the objects with a suitable abrasive composition in the barrel of a tumbling apparatus. U.S. Pat. No. 4,045,918 to Freedman discloses an abrading and polishing tumbler apparatus having one or two barrels in which in which the tumbler barrel is concurrently rotated and rocked and includes an internally ribbed barrel having a separable closure cap at one end. This apparatus has a fairly complex drive mechanism and is noisy when being operated as the stones in the tumbler clang against the side wall of the tumbler as the tumbler is rotated.

U.S. Pat. No. 6,254,466 B1 discloses a tumbler for abrading small parts and rocks in which the objects are placed into a cylindrical drum or barrel along with a grinding medium and liquid. This patent teaches that the barrel can be made of rubber. But, like Freedman this patent also does not mention noise as being a problem, perhaps because the rocks are in a liquid as they are being ground.

Rock tumblers have been made is several sizes ranging from those having barrels that are several meters in diameter for industrial use to table top tumblers which are about 10 to 15 centimeters in diameter. Smaller rock tumblers are available in some toy stores and craft stores for use by children. These products are often used indoors where noise from rocks clanging in the tumbler can be annoying. Consequently, there is a need for a very quiet rock tumbler that can be used by children indoors.

SUMMARY OF THE INVENTION

I provide an ultra-quiet rock tumbler which has a barrel assembly supported on two uprights extending from a base. The barrel assembly has an inner barrel with a removable top, that fits into a middle barrel having a removable top, that fits into an outer barrel having a removable top. Energy absorbing material, preferably polyurethane foam, surrounds both the inner barrel and the middle barrel. The energy absorbing material creates a snug fit of the inner barrel within the middle barrel and of the middle barrel within the outer barrel. Rocks and minerals are placed in the inner barrel with a grinding powder material such as sand and preferably a small amount of water. The user puts the top on the inner barrel, places the inner barrel within the middle barrel, places the top on the middle barrel, places the middle barrel in the outer barrel and puts the cover on the outer barrel. Preferably the foam has a thickness which results in at least a portion of the foam being compressed between adjacent sidewalls of the inner barrel and middle barrel and of the middle barrel and outer barrel. This assembly is then placed on the uprights. A motor on the base engages and turns the barrel assembly to polish the stones. This arrangement enables the foam material to absorb the sound and vibration of the rocks striking the wall of the inner barrel such that the rock tumbler is much quieter than a conventional rock tumbler having a single barrel or tumbler.

Preferably the outer barrel side wall, the middle barrel side wall and the inner barrel side wall each define a polygon. The polygon defined by the middle barrel side wall is the same polygon shape as the polygon defined by the outer barrel side wall and has a smaller diameter than the polygon defined by the outer barrel side wall. The polygon defined by the inner barrel side wall is the same polygon shape as the polygon defined by the middle barrel side wall and has a smaller diameter than the polygon defined by the middle barrel side wall. This arrangement prevents the inner barrel from rotating relative to the middle barrel and prevents the middle barrel form rotating relative to the outer barrel.

The barrel assembly may be rotated by a motor on the base or in one of the uprights. In a preferred embodiment the motor has an axle that is turned when the motor is activated and there is a roller on the axle. The outer barrel side wall has a circular portion that is engaged by the roller such that when the motor is activated the turning roller will cause the barrel assembly to rotate.

Other features and advantages of the present rock tumbler will become apparent from a description of certain present preferred embodiments shown in the drawings.

DESCRIPTION OF THE PREFERRED EMBODIMENTS

Figure 1:
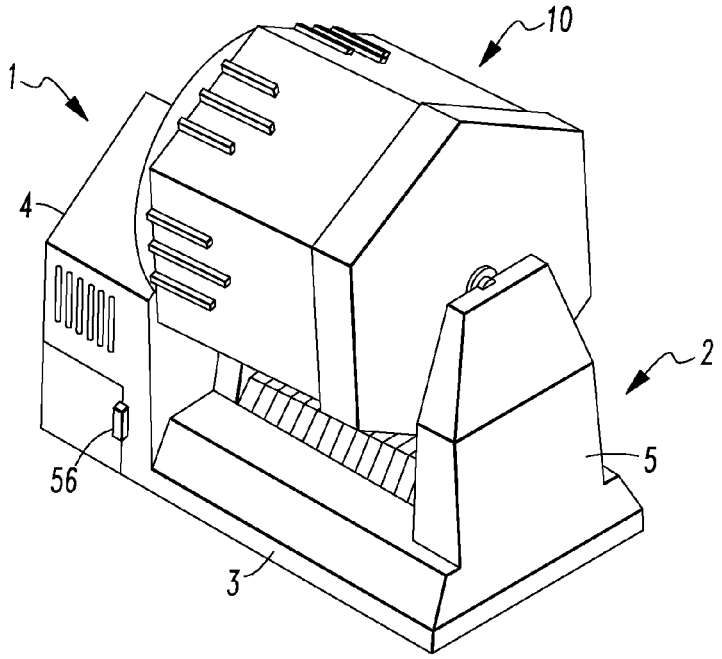
FIG. 1 is a front perspective view of a present preferred embodiment of the rock tumbler.
Figure 2:
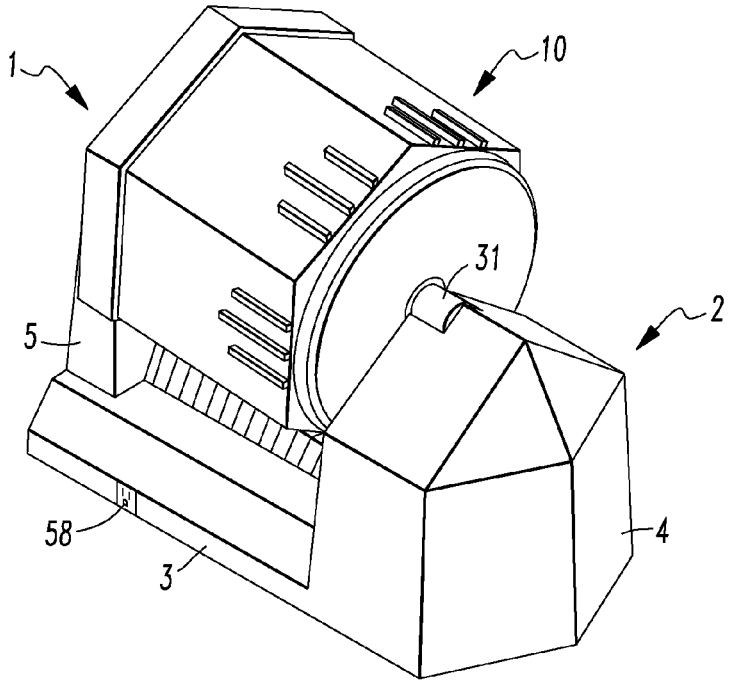
FIG. 2 is a rear perspective view of the embodiment of the rock tumbler shown in FIG. 1.
Figure 3:
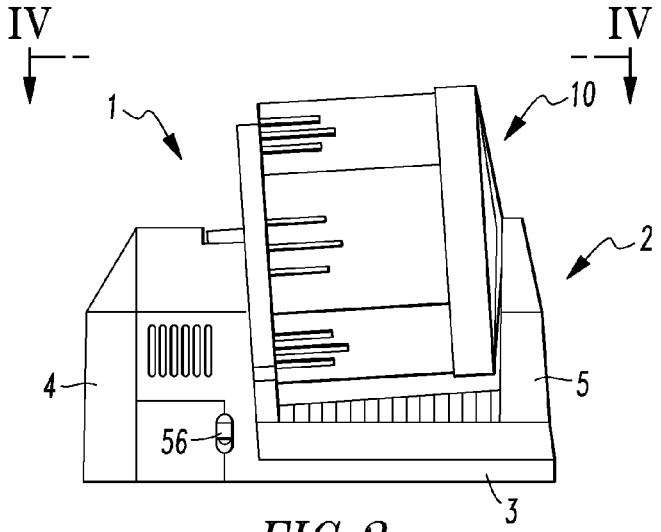
FIG. 3 is a front view embodiment of the rock tumbler shown in FIGS. 1 and 2.
Figure 7:
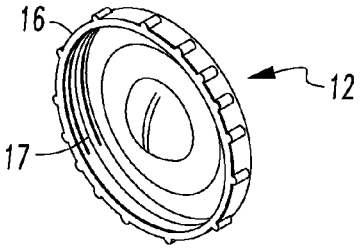
FIG. 7 is a perspective view of the top for the inner barrel in the embodiment of the rock tumbler shown in FIGS. 1 through 6.
Figure 8:
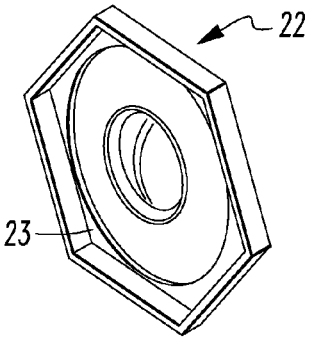
FIG. 8 is a perspective view of the top for the middle barrel in the embodiment of the rock tumbler shown in FIGS. 1 through 6.
Figure 9:
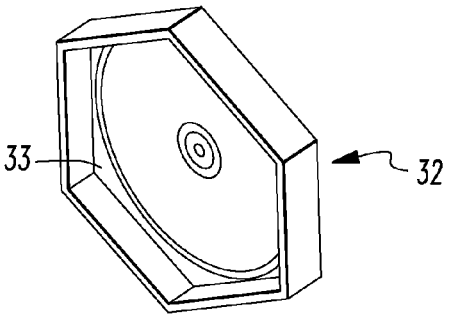
FIG. 9 is a perspective view of the top for the inner barrel in the embodiment of the rock tumbler shown in FIGS. 1 through 6.

Referring to FIGS. 1 through 6 a rock tumbler 1 has a barrel support 2 and a barrel assembly 10. The barrel support has a base 3, a first upright 4 attached to the base and a second upright 5 spaced apart from the first upright 4 and attached to the base 3. There is a first axle seat 6 on the first upright 4 and a second axle seat 7 on the second upright 5. The barrel assembly 10 has an inner barrel 11 with a removable top 12 that fits into a middle barrel 20 which has a removable top 22. The middle barrel 20 fits into an outer barrel 30 having a removable top 32. As can be seen most clearly in FIGS. 4 and 6 energy absorbing material 41 is provided on the inside surface of the base 34 of the outer barrel, on the inside surface of the side wall 35 of the outer barrel and on the inside surface 33 of the top 32 of the outer barrel. This energy absorbing material surrounds the middle barrel when the middle barrel is placed in the outer barrel and the top is placed on the outer barrel. Energy absorbing material 42 is provided on the inside surface of the base 24 of the middle barrel, on the inside surface of the side wall 25 of the middle barrel and on the inside surface 23 of the top 22 of the middle barrel. This energy absorbing material surrounds the inner barrel when the inner barrel is placed in the middle barrel and the top is placed on the middle barrel. The energy absorbing material preferably is a foam material made of polyurethane or polyvinyl chloride.

Preferably the side wall of the outer barrel has a circular portion 37 at one end and a larger portion 38 which defines a polygon shape. The polygon in the present preferred embodiment is a hexagon, but the shape could be another polygon such as a square or an octagon. The middle barrel side wall also defines a hexagon shape, but that hexagon has a smaller diameter so the middle barrel fits into the outer barrel. Similarly, the side wall of the inner barrel also defines a hexagon, that hexagon having a smaller diameter than the hexagon defined by the sidewall of the middle barrel. The polygon configuration prevents the inner barrel from rotating relative to the middle barrel and prevents the middle barrel from rotating relative to the outer barrel. A circular rim 14 having threads 15 is provided on the side wall 13 of the inner barrel at the mouth of the inner barrel 10. The inner barrel top 12 is circular and has a rim 16 with threads 17 that engaged threads 15 on the rim 14 of the inner barrel side wall. This screw type connection provides a tighter seal than the friction fit tops used for the middle barrel and the outer barrel. The tighter seal is needed because the inner barrel may contain water or other liquid with grinding powder and the stones to be polished.

Figure 4:
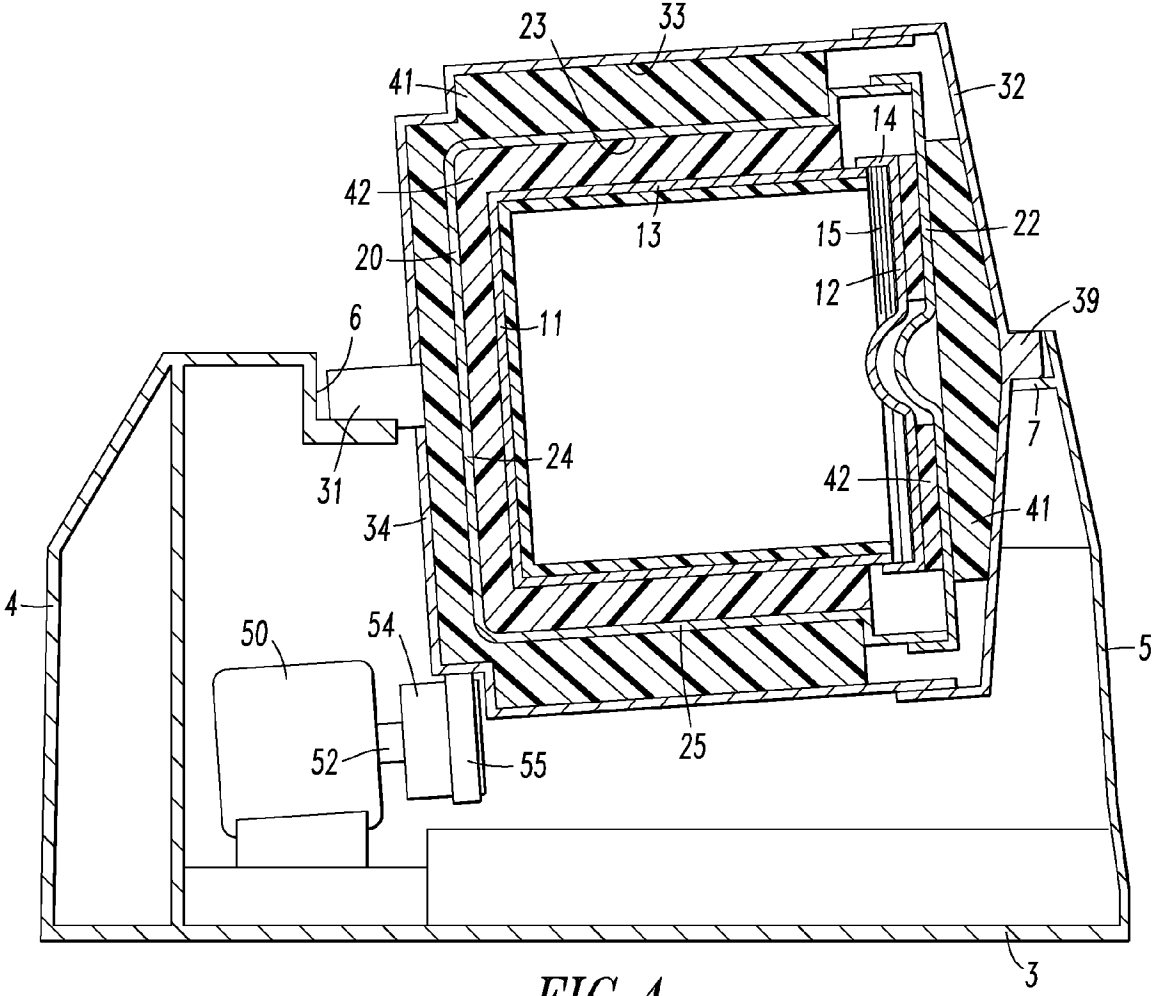
FIG. 4 is a sectional view taken along the line IV-IV in FIG. 3.
Figure 5:
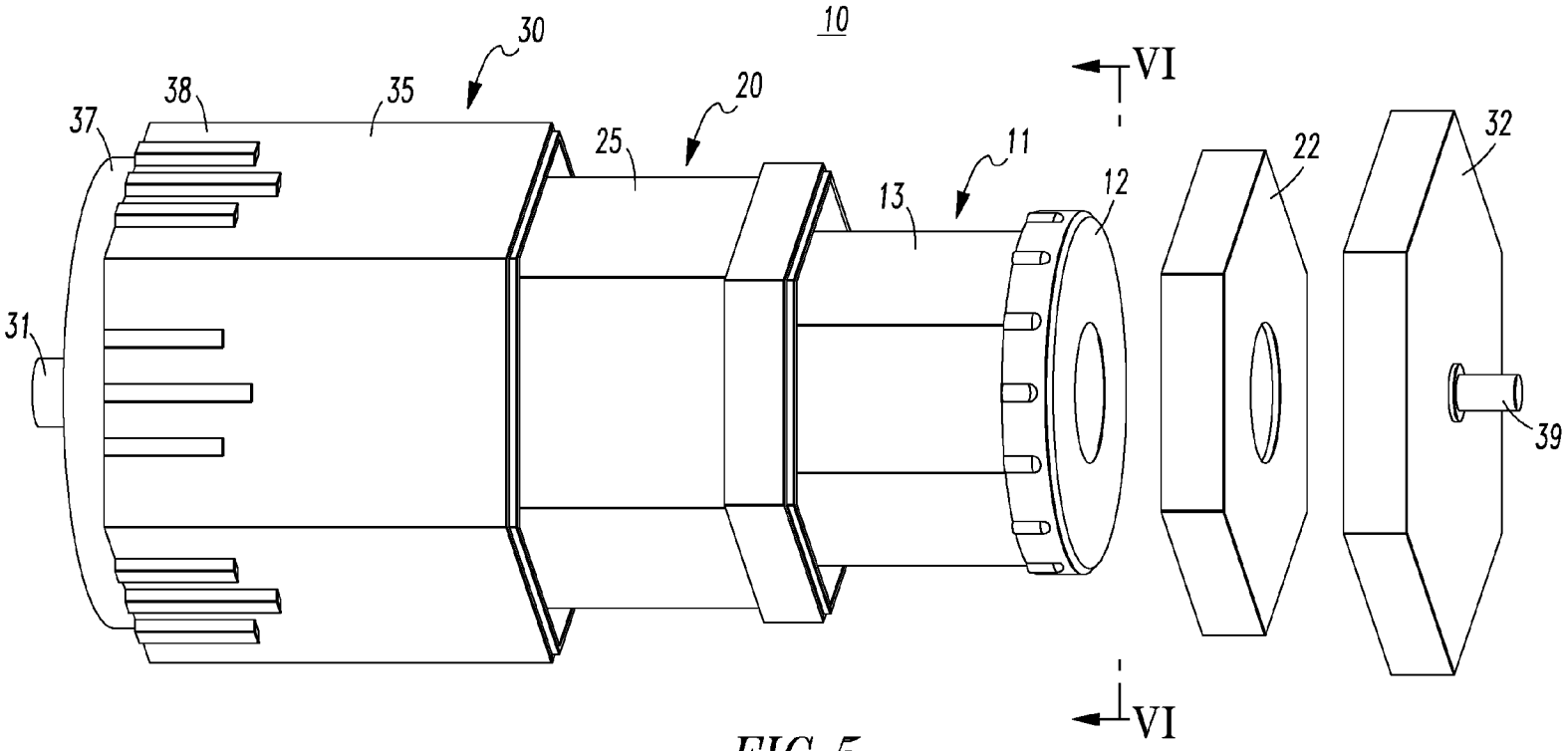
FIG. 5 is partially exploded end view of the barrel assembly in the embodiment of the rock tumbler shown in FIGS. 1 through 4.
Figure 6:
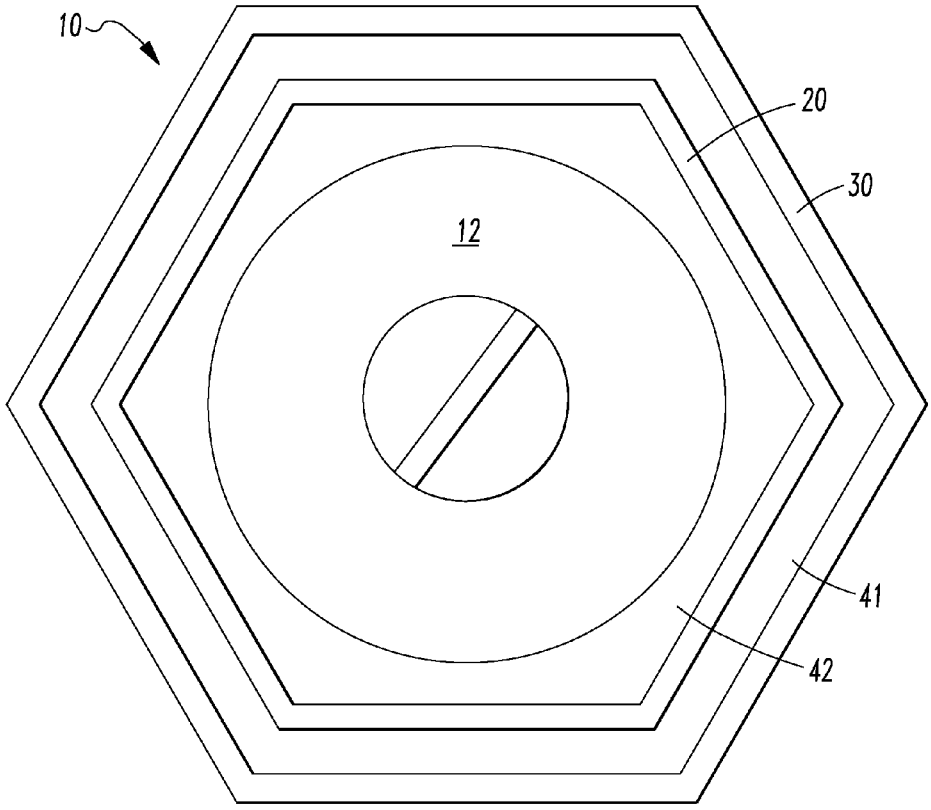
FIG. 6 is a view taken along the line VI-VI in FIG. 5.

Referring to FIGS. 4 and 5 a first axle 31 is attached to the outer surface of the base of the outer barrel. That axle 31 is seated on the first axle seat 6 of the first upright 4 when the barrel assembly is held on the support 2. A second axle 39 is attached to the outer surface of the top 32 of the outer barrel. That axle 32 is seated on the second axle seat 7 on the second upright 5 when the barrel assembly is held on the support 2. Preferably the second axle seat 7 is higher than the first axle seat 6 relative to the base 3 so that the barrel assembly 10 is tilted relative to the base. The first axle 31 and the first axle seat 6 are larger in diameter than the second axle 39 and the second axle seat 7 so that the barrel assembly can only be placed on the support in an orientation where the base 34 of the outer barrel is lower than the top 32 of the outer barrel 30 relative to the base 3.

The barrel assembly is rotated by a barrel mover such as motor 50 having an axle 52 with a roller or wheel 54. A tire 55 may be provided on the wheel, the tire being made of a softer material such as rubber than the wheel. When the barrel assembly 10 is held on the uprights 4, 5 the roller or wheel 54 engages the circular portion 37 of the outer barrel side wall. A switch 56 is provided on the first upright 4 to enable the user to turn the motor on and off. When the motor is operating the roller 54 will turn causing the barrel assembly 10 to rotate around an axis (not shown) that extends from the first axle 31 to the second axle 39. A receptacle 58 is provided on the back of the first upright for an AC/DC adapter which provides power to the motor. Alternatively the motor can be battery powered. Rather than provide a wheel to turn the barrel assembly the motor can be positioned and configured to drive either axle 31 or 39 on the outer barrel. The motor may be connected to the axle directly or by a belt or gears.

The present preferred embodiment of the rock tumbler 1 is intended to be used on a table top or bench. It has a length of 270 mm, a width of 143.5 mm and a height of 227.2 mm. The outer barrel has a diameter of 144 mm between opposite side wall segments and a height of 175.8 mm between the end of the first axle 31 and the end of the second axle 39. The middle barrel has a height of 122 mm and a diameter of 127.7 mm between opposite side wall segments. The inner barrel has a height of 108.8 mm and a diameter of 112.9 mm between opposite side wall segments.

The inner barrel, middle barrel, outer barrel and their tops are preferably made of a plastic such as polycarbonate. The base and uprights of the barrel support as well as the wheel that is driven by the motor can be made of the same plastic material.

To operate the rock tumbler the user removes top 12 from the inner barrel 11. At that time the inner barrel will usually have been separated from the middle barrel. Then the user places the stones to be polished along with a grit powder, such as sand or other abrasive powder, into the inner barrel. A small amount of water can also be added. Next the user tightly secures the inner barrel top 12 onto the rim 14 of the inner barrel. Then the user places the inner barrel into the middle barrel and puts the top on the middle barrel. Finally the user places the middle barrel into the outer barrel and puts the top on the outer barrel. The middle barrel may have been placed in the outer barrel before the user places the inner barrel into the middle barrel. The outer barrel 30 containing the middle barrel and the inner barrel is then placed on the barrel support so that the circular portion 37 of the outer barrel engages the roller or wheel 54 that is turned by the motor. Next the user turns on the motor causing the outer barrel 30 to rotate. The motor is allowed to run a sufficient time for the abrasive powder to polish the stones. This may be several hours. Then the inner barrel is removed and opened to retrieve the polished stones. Preferably two or more grades of abrasive powder including a coarse grind power and a fine grind power are provided. The tumbling process just described is first conducted using the coarse powder and then repeated one or more times using successively finer grades of abrasive powder. The rock tumbler may be sold as part of a jewelry making kit that includes rings, earrings, keychains, and other types of jewelry or jewelry components on which the polished stones can be mounted. An adhesive for mounting the polished stones on jewelry components may also be included in the kit.

Although one could make a rock tumbler having an inner barrel surrounded by an energy absorbing material in an outer barrel, the use of only two barrels is noisier that the three barrel rock tumbler described here. In a commercial embodiment of the rock tumbler shown in the drawings one could hardly hear the rocks being tumbled over the hum of the motor. One could also make a similar rock tumbler having three or more barrels, each surrounded by an energy absorbing material and being within an outer barrel. But the use of three or more barrels makes the rock tumbler more expensive and not much quieter than the rock tumbler shown in the drawings.

Although certain present preferred embodiments of the rock tumbler have been described and illustrated it should be understood that the invention is not limited thereto and may be variously embodied within the scope of the following claims.

What is claimed is:

1. A rock tumbler comprising:

a barrel support comprised of:

a base, a first upright attached to the base the first upright having a first axle seat, and a second upright attached to the base and having a second axle seat, wherein the first upright is spaced apart from the second upright;

an outer barrel comprised of:

an outer barrel base having an inside surface and an outside surface, an outer barrel side wall attached to the outer barrel base and having an inside surface, a removable outer barrel top having an inside surface and an outside surface, the outer barrel top removably attached to the outer barrel sidewall such that the outer barrel base, the outer barrel sidewall and the outer barrel top define an outer barrel cavity, the outer barrel cavity having an outer barrel inner diameter;

a first axle attached to the outer surface of the outer barrel base and seated on the first axle seat of the first upright, and a second axle attached to the outer surface of the outer barrel top and seated on the second axle seat of the second upright, and outer barrel energy absorbing material on the inside surface of the outer barrel base, on the inside surface of the outer barrel side wall and on the inside surface of the outer barrel top;

a middle barrel positioned within the outer barrel cavity, the middle barrel comprised of:

a middle barrel base having an inside surface and an outside surface, a middle barrel side wall attached to the middle barrel base and having and inside surface, a removable middle barrel top having an inside surface, the middle barrel top removably attached to the middle barrel sidewall such that the middle barrel base, the middle barrel sidewall and the middle barrel top define an middle barrel cavity, and middle barrel energy absorbing material on the inside surface of the middle barrel base, the inside surface of the middle barrel side wall and the inside surface of the middle barrel top;

an inner barrel positioned within the middle barrel cavity, the inner barrel comprised of:

an inner barrel base having an inside surface and an outside surface, an inner barrel side wall attached to the inner barrel base, and a removable inner barrel top having an inside surface and an outside surface, the inner barrel top removably attached to the inner barrel sidewall such that the inner barrel base, the inner barrel sidewall and the inner barrel top define an inner barrel cavity; and a barrel mover attached to the barrel support which engages the outer barrel and when activated causes the outer barrel to rotate.

2. The rock tumbler of claim 1 wherein at least a portion of the outer barrel side wall is circular and the barrel mover is comprised of a motor having an axle that is turned when the motor is activated and a roller on the axle, the roller engaging the circular portion of the outer barrel side wall.

3. The rock tumbler of claim 1 wherein the outer barrel the side wall, the middle barrel side wall and the inner barrel side wall each define a polygon, the polygon defined by the middle barrel side wall having a same polygon shape as the polygon defined by the outer barrel side wall and having a smaller diameter than the polygon defined by the outer barrel side wall and the polygon defined by the inner barrel side wall having a same polygon shape as the polygon defined by the middle barrel side wall and having a smaller diameter than the polygon defined by the middle barrel side wall.

4. The rock tumbler of claim 3 wherein the polygon shape is a square, a hexagon or an octagon.

5. The rock tumbler of claim 1 wherein the inner barrel top has threads that engage threads on the inner barrel side wall.

6. The rock tumbler of claim 1 wherein the outer barrel energy absorbing material and the middle barrel energy absorbing material are a foam material.

7. The rock tumbler of claim 6 wherein the foam material is polyurethane or polyvinyl chloride.

8. The rock tumbler of claim 1 wherein the first axle has a first axle diameter and the second axle has a second axle diameter, the first axle diameter being different from the second axle diameter.

9. The rock tumbler of claim 1 wherein the outer barrel, the middle barrel and the inner barrel are plastic.

10. The rock tumbler of claim 1 wherein the barrel mover is comprised of a DC motor and a receptacle for an AC/DC power adapter.

11. A rock tumbler comprising:

a barrel support comprised of:

a base, a first upright attached to the base the first upright having a first axle seat, and a second upright attached to the base and having a second axle seat, wherein the first upright is spaced apart from the second upright;

an outer barrel comprised of:

an outer barrel base having an inside surface and an outside surface, an outer barrel side wall attached to the outer barrel base and having an inside surface, a removable outer barrel top having an inside surface and an outside surface, the outer barrel top removably attached to the outer barrel sidewall such that the outer barrel base, the outer barrel sidewall and the outer barrel top define an outer barrel cavity, the outer barrel cavity having an outer barrel inner diameter;

a first axle attached to the outer surface of the outer barrel base and seated on the first axle seat of the first upright, and a second axle attached to the outer surface of the outer barrel top and seated on the second axle seat of the second upright, and outer barrel energy absorbing material on the inside surface of the outer barrel base, on the inside surface of the outer barrel side wall and on the inside surface of the outer barrel top;

an inner barrel positioned within the outer barrel cavity, the inner barrel comprised of:

an inner barrel base having an inside surface and an outside surface, an inner barrel side wall attached to the inner barrel base, and a removable inner barrel top having an inside surface and an outside surface, the inner barrel top removably attached to the inner barrel sidewall such that the inner barrel base, the inner barrel sidewall and the inner barrel top define an inner barrel cavity; and a barrel mover attached to the barrel support which engages the outer barrel and when activated causes the outer barrel to rotate.

12. The rock tumbler of claim 11 wherein at least a portion of the outer barrel side wall is circular and the barrel mover is comprised of a motor having an axle that is turned when the motor is activated and a roller on the axle, the roller engaging the circular portion of the outer barrel side wall.

13. The rock tumbler of claim 1 wherein the outer barrel the side wall and the inner barrel side wall each define a polygon, the polygon defined by the inner barrel side wall having a same polygon shape as the polygon defined by the outer barrel side wall and having a smaller diameter than the polygon defined by the outer barrel side wall.

14. The rock tumbler of claim 13 wherein the polygon shape is a square, a hexagon or an octagon.

15. The rock tumbler of claim 11 wherein the inner barrel top has threads that engage threads on the inner barrel side wall.

16. The rock tumbler of claim 11 wherein the outer barrel energy absorbing material is a foam material.

17. The rock tumbler of claim 16 wherein the foam material is polyurethane or polyvinyl chloride.

18. The rock tumbler of claim 11 wherein the first axle has a first axle diameter and the second axle has a second axle diameter, the first axle diameter being different from the second axle diameter.

19. The rock tumbler of claim 11 wherein the outer barrel and the inner barrel are plastic.

20. The rock tumbler of claim 11 wherein the barrel mover is comprised of a DC motor and a receptacle for an AC/DC power adapter.

* * * * *